United States Patent [19]

Stadelman et al.

[11] Patent Number: 4,938,364

[45] Date of Patent: Jul. 3, 1990

[54] PRESENTATION DISPLAY STORAGE SYSTEM

[76] Inventors: Hildegarde A. Stadelman; Fred E. Stadelman, both of Park La., North White Plains, N.Y. 10604

[21] Appl. No.: 197,282

[22] Filed: May 23, 1988

[51] Int. Cl.[5] ..... A47F 7/16

[52] U.S. Cl. ..... 211/47; 108/94; 108/103; 211/150; 211/169; 211/205; 248/124

[58] Field of Search ..... 248/124; 211/45, 47, 211/58, 59.4, 129, 144, 150, 13, 196, 169, 205; 108/94, 103, 139

[56] References Cited

U.S. PATENT DOCUMENTS

| | | | |
|---|---|---|---|
| 254,306 | 2/1882 | Haley | 211/150 X |
| 1,027,701 | 5/1912 | Deming | 211/129 X |
| 2,092,430 | 9/1937 | Stratton | 211/150 X |
| 2,990,068 | 6/1961 | Topel | 211/150 X |
| 3,008,680 | 11/1961 | Hoffman | 211/144 X |
| 3,167,186 | 1/1965 | Squire | 211/150 |
| 3,235,093 | 2/1966 | Eisbart et al. | 211/47 |
| 3,534,863 | 10/1970 | Howard | 211/47 |
| 4,688,684 | 8/1987 | Young et al. | 211/59.4 |
| 4,756,429 | 7/1988 | Lehman et al. | 211/205 X |

FOREIGN PATENT DOCUMENTS

| | | | |
|---|---|---|---|
| 2132751 | 1/1973 | Fed. Rep. of Germany | 211/45 |
| 589671 | 3/1959 | Italy | 211/58 |
| 4886 | of 1876 | United Kingdom | 108/94 |

*Primary Examiner*—David L. Talbott
*Attorney, Agent, or Firm*—Carl Kling

[57] ABSTRACT

Variable display presentation of carpet samples with variable juxtaposition is accomplished by a presentation display storage system which is economical, light in weight, easily assembled without tools, easily movable and subject to easy rearrangement of the samples. The system is made up of a wheeled starbase which supports a vertical spindle upon which presentation platforms are mounted. A slide-and-spin-resistant support slider is positioned at a baseline position axially on the spindle. A bottom presentation platform, made up of a relatively fragile lightweight presentation platform shelf and a hold-down slider, cantilever the presentation platform by compressing the shelf between itself and the support slider. The top surface of the hold-down slider forms a support surface for the presentation platform shelf of the overlying presentation platform, in sequence. There is an aperture in the presentation platform shelf which is dimensioned sufficiently larger than the spindle to be relieved of any significant support stress from the spindle. All support stress is borne by the support slider and the hold-down slider, which have essentially central apertures dimensioned for slide-and-spin-resistant tight fit on the spindle. Each presentation platform shelf has a mesh fastening pad to coact with a hook pad on the carpet sample which is to be its burden; this permits easy change of carpet samples.

2 Claims, 4 Drawing Sheets

PRESENTATION DISPLAY STORAGE SYSTEM

BACKGROUND OF THE INVENTION

1. Field of the Invention

This invention relates to presentation display systems, and more particularly relates to a presentation display system for floor covering samples or other objects of substantial weight requiring horizontal presentation display.

2. Description of Related Art

There are a number of presentation display techniques for carpet samples, ranging from the simple stack of carpets to the waterfall. Such display techniques also include the plain pipe rack with hangers, color wheel with wires to the basket rack to newspaper-on-pole library racks to house-of-cards supports. The desire is to present the carpet samples effectively and conveniently; in the closest simulation possible to on-floor flatness; within reach for touching; in close juxtaposition to other sample carpets and to drapery fabric samples; safely; in more than one lighting position. The problem is that carpet samples are heavy, expensive and unweildy. Carpet samples vary greatly in weight, material, weave, texture, etc. and come in a great variety of colors; even a small salesroom, with virtually no inventory of actual carpeting, may have hundreds of carpet samples. These samples must be kept up to date, since new styles and colors continually replace discontinued styles and colors. The samples must be kept fresh and clean, easy to view and touch—with as little effort and expense as possible. It is very advantageous to be able to move the presentation display to a different light and see all the colors instead of just a portion.

There is a need for a movable carpet sample presentation display which is visually pleasing, reasonable in cost, safe, and able to provide variable juxtaposition of carpet sample to carpet sample within its repertoire. The waterfall is not portable, and generally requires large size samples. These large-size samples are heavy and awkward for the salesperson and customer to review. The large sample on top is seen in its entirety, but as the stack progresses to the bottom only a very small portion becomes visible. The carpet is not presented in its proper perspective which should be horizontal. While it is theoretically possible to maneuver two non-adjacent carpet samples for a side-by-side joint presentation, it is quite difficult in practice. Key-ring and maypole systems become cumbersome if the number of carpet samples is greater than a very few; chains and grommets are usually required. Since the desire is to attract the customer to the display, the display system must be stable so as to present minimum hazard. Safety considerations as well as cost considerations militate against various motorized carousel devices; the aggregate mass of the carpet samples and supports can deliver a significant punch.

There are a great number of small portable carousel-type display presentation systems which use a base, spindle and presentation platforms, pins or surfaces. These tend to be balanced systems symmetrical to the spindle. There are none known which use the modularity of the presentation platform with substantial spacer utilizing the weight of the presentation platform and the presentation item both to provide support for the cantilevered presentation platform and to damp rotation.

SUMMARY OF THE INVENTION

The invention is a display presentation system having a base-supported spindle, one or more presentation platforms each having a relatively low mass platform of significant length arranged with an off-center aperture sized for acceptance of the spindle. Each presentation platform is subject to mounting on the spindle by being sandwiched between an adjacent slide-and-spin-resisting spacer support and a paired slide-and-spin-resisting hold-down spacer. In the usual system, the spindle is upright, supported by a wheeled star platform. There is an original spacer support locked to the spindle by friction or other locking means. There are one or more (usually many) presentation platforms. Each presentation platform is held cantilevered out from the spindle by its own weight and the combined weight of the overlying presentation platforms with their respective slide-and-spin-resisting hold-down spacer and burdens. The representative burden is a carpet sample of thickness essentially that of the hold-down spacer. The spacers are flat, apertured for tight match to the spindle so as to be slide-resisting due to significant linear friction with the spindle. Each hold-down spacer is assembled into a unit with the presentation platform shelf so as to locate the presentation platform shelf with respect to the spindle; each hold-down spacer has significant surface so as to provide support to its own platform by sandwiching it between the supporting top surface of the underlying spacer and the bottom surface of the overlying presentation platform shelf.

It is an object of the invention to present floor covering samples economically, with variable juxtaposition and with the greatest possible variability of presentation.

Another object is to present carpet samples safely.

Another object is to present carpet and other floor covering samples on display presentation systems which can be easily moved.

A feature of the invention is its use of lightweight materials to support the weight of the carpet samples, using the weight of the carpet samples themselves to add strength and rigidity to the presentation platforms of the system.

Another feature of the invention is its modular nature, with the presentation platforms being essentially rectangular and flat for compact cartoning for delivery and storage, and with the number and position of the presentation platforms being easily changed by salespersons who may not have much mechanical training.

An advantage of the system is that a single presentation platform may be placed on the spindle at the desired height, with additional presentation platforms being added as desired.

Another advantage of the presentation display system of the invention is that all its presentation platforms may be rotated to the same position for compact storage.

The presentation display system of the invention has been described with respect to carpet samples and other floor covering (the original field of utility) but it is also useful for presentation display of jewelry, shirts, medical implements, precision parts, or other items. Other objects, features and advantages of the invention will be apparent to those familiar with presentation storage systems.

DETAILED DESCRIPTION OF THE PREFERRED EMBODIMENT

Figure 1:
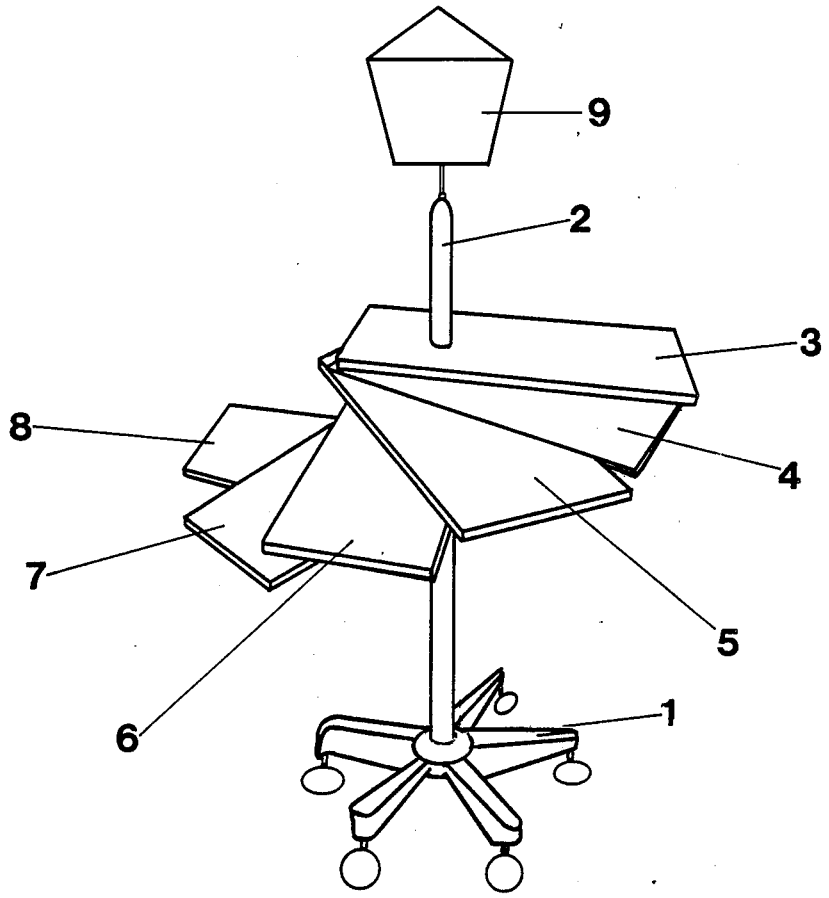
FIG. 1 is a perspective view of the presentation display system of the invention.

FIG. 1 shows the presentation display system in the best mode and preferred embodiment. Star base 1 supports spindle 2, which in turn supports presentation platforms 3,4 . . . 8 sign 9. Star base 1 preferably is equipped with lockable casters appropriate for the showroom floor. Note that the rotational positions of presentation platforms 3–8 may vary infinitely. The spiral shown is a favored initial positioning, but each presentation platform is capable of full 360 degree rotational positioning, regardless of the position of others. Assuming that starbase 1 is reasonably matched to the cantilever length of the presentation platforms as burdened, the system is stable even if all presentation platforms are positioned identically.

Figure 2:
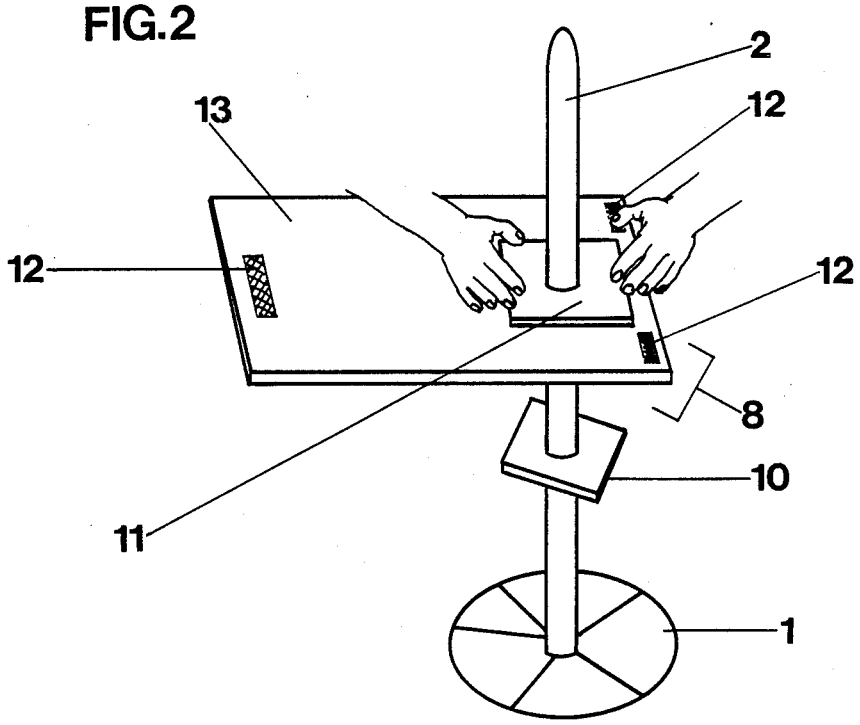
FIG. 2 is a perspective view of the partially assembled presentation display system of the invention.

FIG. 2 shows how the bottom slide-and-spin-resistant spacer 10 is positioned to set the essential height of presentation. Presentation platform 8, with hold-down spacer 11 already in place and preferably permanently affixed, is worked down until it rests atop spacer 10. This positioning does not require destructive forcing, but does require a firm downward pressure, probably with rotational working, to move the presentation platform 8 down the spindle 2. Light lubrication may be required, for initial assembly only. Spindle 2 is preferably chrome-plated steel tubing of significant diameter, for example, 35 mm. Note that the distal end of spindle 2 is tapered for convenient assembly of the spacers and presentation platforms. The person assembling the system may need to step on the starbase 1 to prevent spindle rotation during the working of the spacers into position.

FIG. 2 also shows mesh pads 12 which coact with hook pads (not shown) on the carpet sample (not shown) which is to be the burden for this presentation platform. Hook and mesh fasteners are widely marketed under the brand name VELCRO. Other fasteners will also suffice, depending upon the burden. The preferred material for the presentation platform shelf (i.e., 13) is an extruded double-skinned acrylic plastic sheet with linear rectangular chambers, marketed under the brand name EXOLITE. The preferred material for the spacers (10 and 11 shown in FIG. 2) is ultra-high molecular weight polyethylene. The shelf material, while strong enough to support its burden at the lever-arm length cantilevered, is fragile relative to the robust polyethylene spacer.

Figure 3:
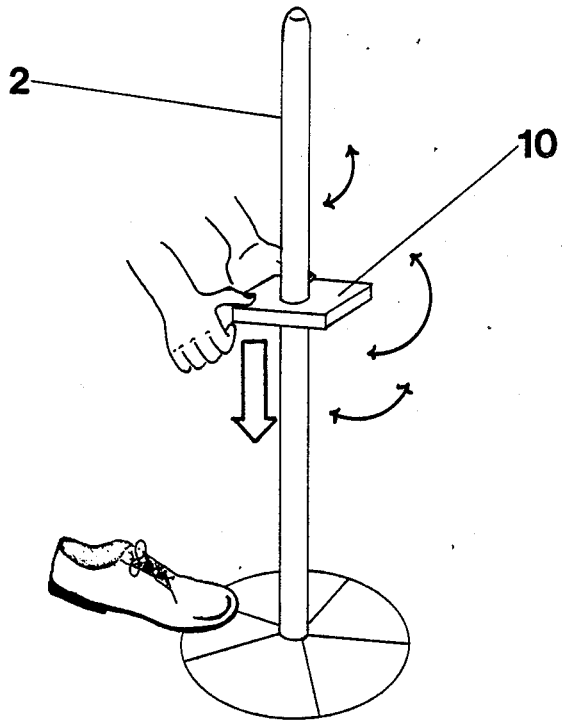
FIG. 3 is a perspective diagram showing how the original spacer support is positioned on the spindle.

FIG. 3 shows how slide-and-spin-resistant spacer 10 is worked onto spindle 2 to form the original base support. It may be desirable to form the original base support of extra heavy duty material, or to equip it with one or more setscrews to ensure positioning, but in the preferred embodiment it is sufficient to use an ordinary slide-and-spin-resistant spacer. Multiple spacers may be used together to generate the necessary friction for stability; these may be individually worked into position for ease of assembly.

Figure 4:
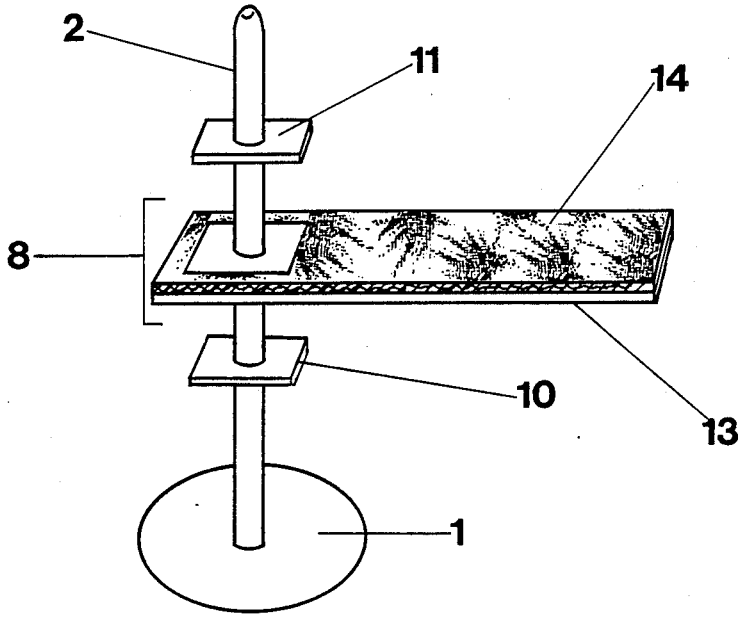
FIG. 4 is an exaggerated-scale diagram showing in simplified form how the presentation display system of the invention is configured during assembly.

FIG. 4 shows in exaggerated scale a representative presentation platform 8 with its burden (carpet sample 14) in place on presentation platform shelf 13. Note that carpet sample 14 has been relieved to provide a place for hold-down spacer 11, which is shown displaced from presentation platform shelf 13 rather than affixed in place as is preferred. Hold-down spacer 11 may be affixed after being worked onto spindle 2, but this is not generally preferred. FIG. 4 does not show any detail of starbase 1, which in the preferred embodiment is a five-point wheeled base available from various manufacturers and similar to the bases of currently popular office chairs. The wheels are preferably lockable. While the fact of a wheeled base is important to practicing the invention in its best mode and preferred embodiment, where movability is desired, the details of the base itself are not critical to the invention. A variety of support mechanisms for the spindle (including post-in-socket, post-in-ground, pedestal pad, etc.) would sometimes be appropriate.

Figure 5:
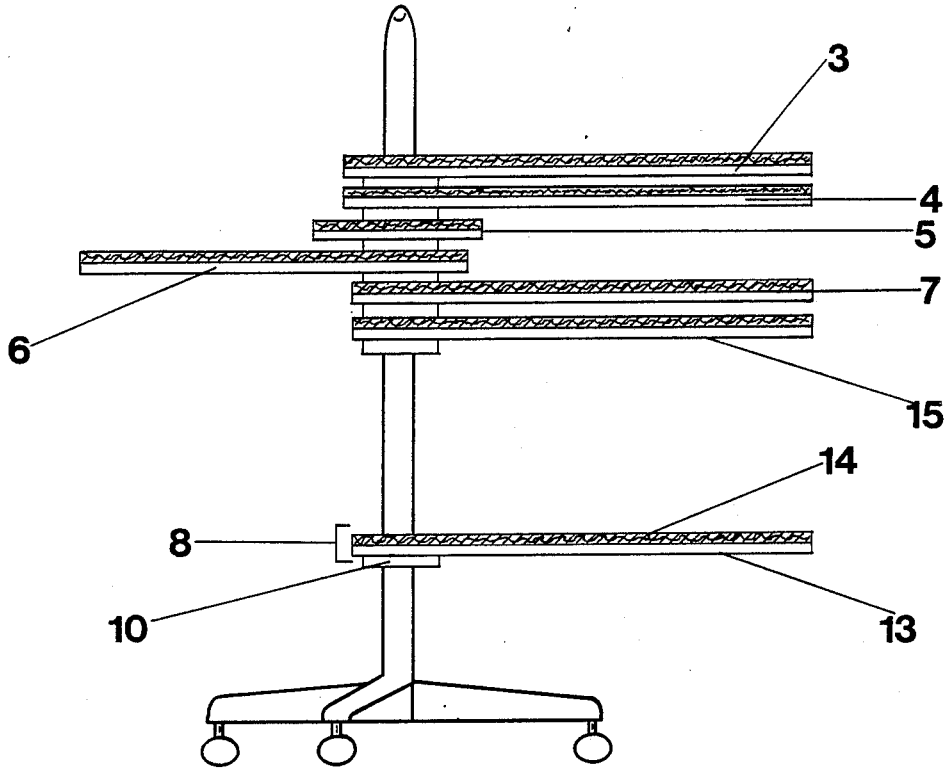
FIG. 5 shows in simplified form in elevation view how the assembled presentation display system supports the presentation platforms sandwiched between slide-and-spin-resistant spacers on the spindle.

FIG. 5 shows in plan view the assembled presentation display system, showing presentation platforms 3,4 . . . 8 as shown in FIG. 1. The presentation platforms carry carpet sample burdens, for example carpet sample 14 on presentation platform shelf 13 of presentation platform 8. Additional presentation platforms (presentation platform 15 is representative of others in the gap between presentation platforms 7 and 8) were included in the assembly sequence 10,8-gap-15,7,6,5,4,3.

Figure 6:
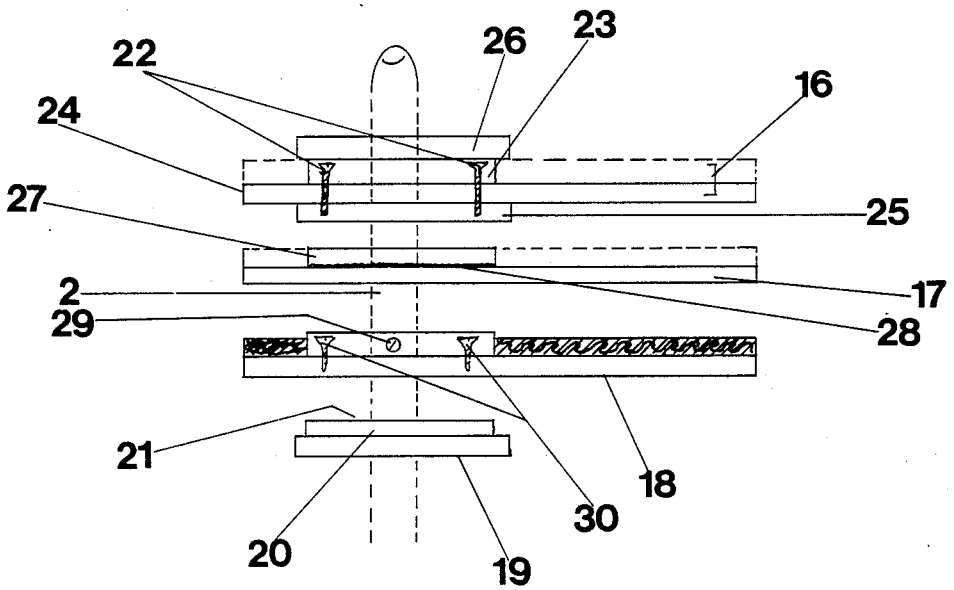
FIG. 6 shows in greater detail some variations in presentation platform and slide-and-spin-resistant spacers.

FIG. 6 shows a variety of details of presentation platforms. Presentation platforms 16–19 differ in construction detail but have the same basic function. The hold-down spacer 20 for presentation platform 19 is of high molecular weight polyethylene. Its surface 21 provide support and rotational slidability which allows for fingertip positioning of each presentation platform. Note that high-quality frictionless bearings could be operationally detrimental in addition to being costly. Near-frictionless mounting would possibly result in dangerously uncontrolled swings.

Remarkable poltergeist repositioning of samples could result as the combination of gravity and traffic vibration moves presentation platforms to the lowest position.

FIG. 6 shows the use of screws 22 to affix slider 23 to shelf 24. Additional spacers 25 and 26 may be added to increase the distance between adjacent presentation platforms. These additional spacers can be affixed to provide additional support. Another variation is to cement shelf 17 and spacer 27 together using double-sided tape 28 or glue to form the presentation platform. Friction may be adjusted using plastic setscrew 29; slider-to-shelf relationship may be obtained without permanent affixment by using pins 30 which may be inserted after the slider has been worked into position.

Figure 7:
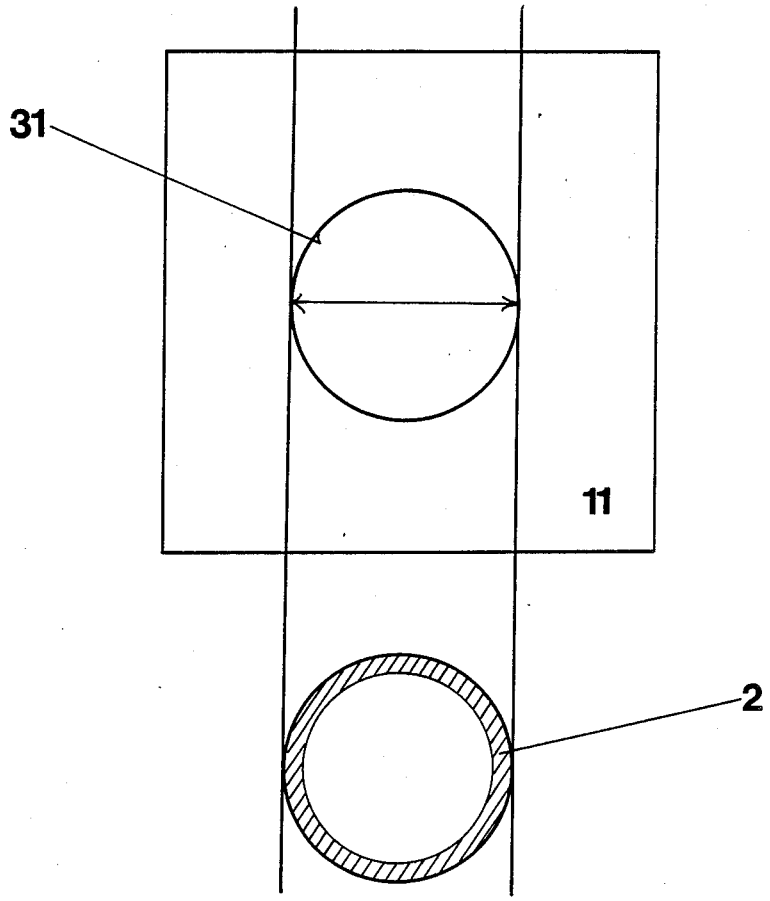
FIG. 7 is a large-scale plan view composite of the spindle and spacer showing a representative tolerance relationship to provide an economical slide-and-spin-resistant spacer from inexpensive materials.

FIG. 7 shows tolerance relationship between spindle 2 and the aperture 31 in a slider such as slider 11. The aperture inner diameter 31 and the spindle outer diameter are essentially identical; because of the slight compressibility of spindle 2 and of the material of slider 11 it is acceptable to open tolerances so long as the slider aperture is not larger than the spindle. This permits a slight forcing to maintain the sliders axially affixed to the spindle 2. The cantilevered weight permits the bearing edge of the slider to bite into the exterior wall of the spindle (microscopically) which helps to hold the display in the configuration set but allow easy rotation as desired. Sliders such as representative slider 11 are preferably square to give a good grip to the assembler during the process of working the slider onto the spindle, but other configuration is acceptable.

Figure 8:
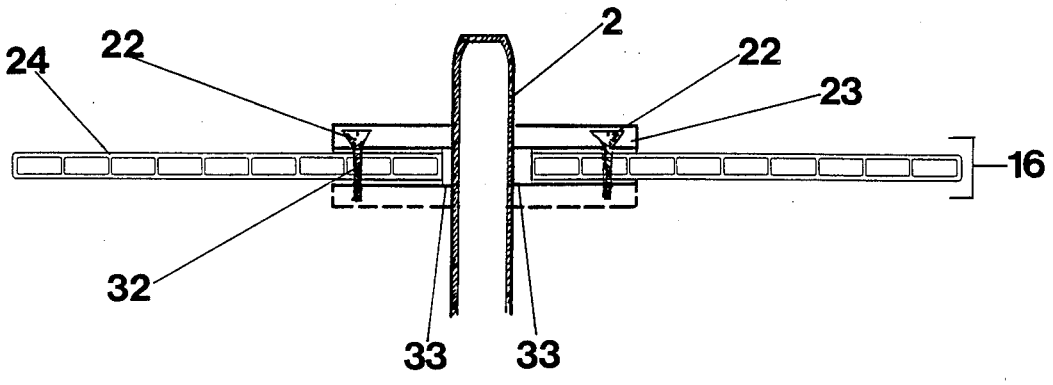
FIG. 8 is a cutaway elevation view of a representative presentation platform showing lightweight presentation platform shelf relieved about the spindle and supported sandwiched between an underlying slide-and-spin-resistant spacer (shown in phantom) and hold-down slide-and-spin-resistant spacer.

FIG. 8 shows a representative presentation platform such as presentation platform 16 of FIG. 6. Slider 23 is affixed to shelf 24 by screws 22. Screws 22 may be held by the plastic of shelf 24, or may be assembled with nuts such as bar-nut 32 which may be inserted into the appropriate longitudinal chamber of shelf 24 to provide additional support. FIG. 8 also shows how shelf 24 may be relieved in the vicinity of spindle 2 (small black areas 33 indicate absence of plastic) to avoid stress to the shelf.

The shelf plastic in the preferred embodiment is transparent to increase the emphasis on the display of the burden, the carpet sample, but the use of colored plastic may be desired. These and other changes in form and detail may be provided within the spirit of the invention, as pointed out in the following claims.

What is claimed is:

1. A presentation display having a supported round spindle (2) of uniform outer diameter, a base support (10) for establishing a base position on said spindle (2), and a set of presentation platforms (i.e., 8) having a presentation platform shelf (i.e., 13) for mounting cantilever to said spindle (2) and a subset of spacers, at least one spacer for each presentation platform is attached to said presentation platform and adapted to surround said spindle (2) and provide minimum spacing along said spindle for the related presentation platform characterized in that each presentation platform shelf is of relatively rigid material and has an aperture sufficiently larger than said spindle (2) to provide relief so as to avoid contact between shelf and spindle; and each presentation platform spacer is a slide-and-spin-resistant slider of relatively tough material with aperture dimensioned for tight fit on said spindle (2) and compressional contact with each related presentation platform, whereby each in the set of presentation platforms gains distributed support along said spindle from said subset of spacers at a fixed axial position while allowing significantly damped rotational motion, the shelf being supported by its related spacers in compression, rather than by said spindle (2).

2. The presentation display system of claim 1, further characterized in that each presentation platform shelf is made up of relatively rigid two-sided longitudinally-channeled plastic.

* * * * *